ELECTRO-MAGNETIC SWITCHING APPARATUS HAVING ELECTRICALLY SEPARATED CONTACT ELEMENTS

BACKGROUND OF THE INVENTION

1. Field of the Invention

The present invention relates generally to electromagnetic switching apparatus, and in particular to an improved electromagnetic switching apparatus having electrically-separated stationary contact elements.

2. Description of the Prior Art

Electromagnetic switching apparatus including stationary contact elements which extend around one end of a plurality of movable contact bridges and which are coupled to terminal elements, and electrically-separated stationary contact elements disposed at the other end of the contact bridges on both sides thereof, are known in the art. For example, German Auslegeschrift No. 1,258,957 discloses an electromagnetic switching apparatus of the foregoing type in which separated fixed, i.e., stationary, contact elements are provided with separate terminals. In this apparatus, the connecting line clamped to the terminals must be changed from one terminal to the other if the function of the contact bridges is to be changed from a "break" function to a "make", i.e., making contact, function. Besides the additional cost of providing an additional terminal for the second contact elements, another disadvantage of this apparatus is that the connecting line or wire must be disconnected and then reconnected in order to change the function of the contact bridges from one of "breaker" to "maker" or vice-versa. In this situation, marking of the terminals is of particular importance so that the wire is not reconnected inadvertently to the terminal of the wrong contact.

SUMMARY OF THE INVENTION

It is therefore an object of the present invention to provide an improved electromagnetic switching apparatus which overcomes the disadvantages of heretofore known apparatus and in which the contact-making function of the apparatus can be changed in a simple manner from a "make" function to a "break" function or vice-versa, without opening wire connections in the apparatus and without opening the switching apparatus or removing it from the switching system.

These and other objects of the invention are achieved in an electromagnetic switching apparatus including a housing, a plurality of movable contact bridges mounted on a contact bridge carrier, first fixed contact elements which extend around one end of the contact bridges and are coupled to terminal elements for the first fixed contact elements, and electrically-separated second fixed contact elements disposed at the other end of the contact bridges on both sides of the contact bridges. The improvement of the invention comprises the provision of means for selectively electrically connecting the second fixed contact elements to a common terminal element.

In one embodiment of the invention, the connecting means comprises a plurality of slidable, electrically-conductive intermediate part members. The advantage of this design is that good electrical contact can be achieved in a simple manner without screw connections since the design permits one to work with a relatively high contact pressure.

Accessibility is reduced to a minimum space when the connecting means are disposed in cylinders each rotatably mounted in the housing of the apparatus with the longitudinal axis thereof disposed transversely with respect to the longitudinal axes of the contact bridges. This design is also particularly advantageous if several contact paths are provided one behind the other transversely with respect to the mounting plane.

The connecting means may comprise a plurality of electrically conductive plug members. Such a design is relatively simple but presents the disadvantage that the jumpers might be lost. This can be overcome by designing the connecting means as screw terminal jumpers and provides the advantage of relatively low contact resistance. Such a design requires, however, an additional screw in most instances.

The connecting means may also comprise spring-loaded brackets which are elastically resilient and have a shape which enables the brackets to be fitted to the terminal or fixed contact element. This arrangement provides a simple design for accommodating the contact loading spring with a minimum of space. Shaping the brackets so that it can be fitted to the terminal or contact element enables the brackets to be designed simultaneously as detent means for the brackets. Such detent means are advantageous to assure the end position of the connecting means, i.e., to avoid changing of the contacts from a "make" function to a "break" function, and vice-versa during operation by vibration or the like.

The connecting means may be mounted in separate parts of the switching apparatus housing which are detachable from the rest of the housing. This enables the connecting means to be changed in a simple manner without taking the switching system out of operation. The apparatus may include position markings disposed on a front side of the housing for indicating the position of the connecting means and the selective electrical connection of the fixed contact elements to the common terminal element without measurement to determine whether the contact is operating as a "make" contact or a "break" contact.

These and other novel features and advantages of the present invention will be described in greater detail in the following detailed description.

BRIEF DESCRIPTION OF THE DRAWINGS

In the drawings, wherein similar reference numerals denote similar elements throughout the several views thereof.

In the embodiment of the invention illustrated in FIGS. 8 through 10, terminal element 9 is electrically connected to fixed contact elements 7 and 8 by means of a plurality of plugtype connectors.

Figure 11:
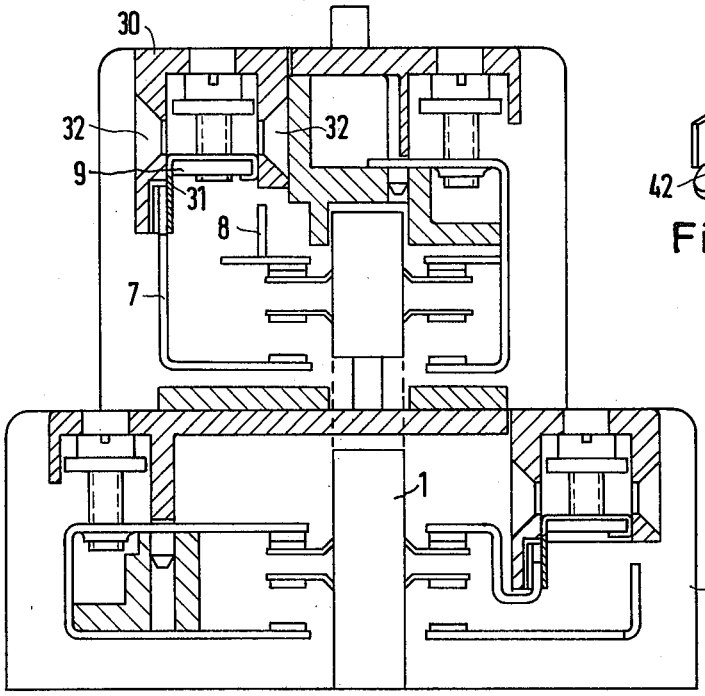
Figure 12:
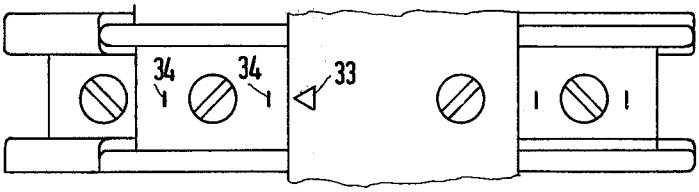

In the embodiment of the invention illustrated in FIGS. 11 and 12, terminal element 9 is disposed in a housing part 30 which is separate and detachable from the rest of the switching apparatus housing. Housing part 30 includes an intermediate electrically-conductive spring 31 which is engageable with fixed contact elements 7 and 8 depending upon which direction housing part 30 is inserted into the switching apparatus housing 2. Housing part 30 has a pair of cone-shaped apertures 32 for receiving the wire connecting lead so that rotation of the housing part 30 through 180° is possible. Position markings 33 are provided on switching apparatus housing 2, as shown in FIG. 12, to indicate, in conjunction with symbols 34 provided on housing part 30, connection of the switching equipment.

Figure 1:
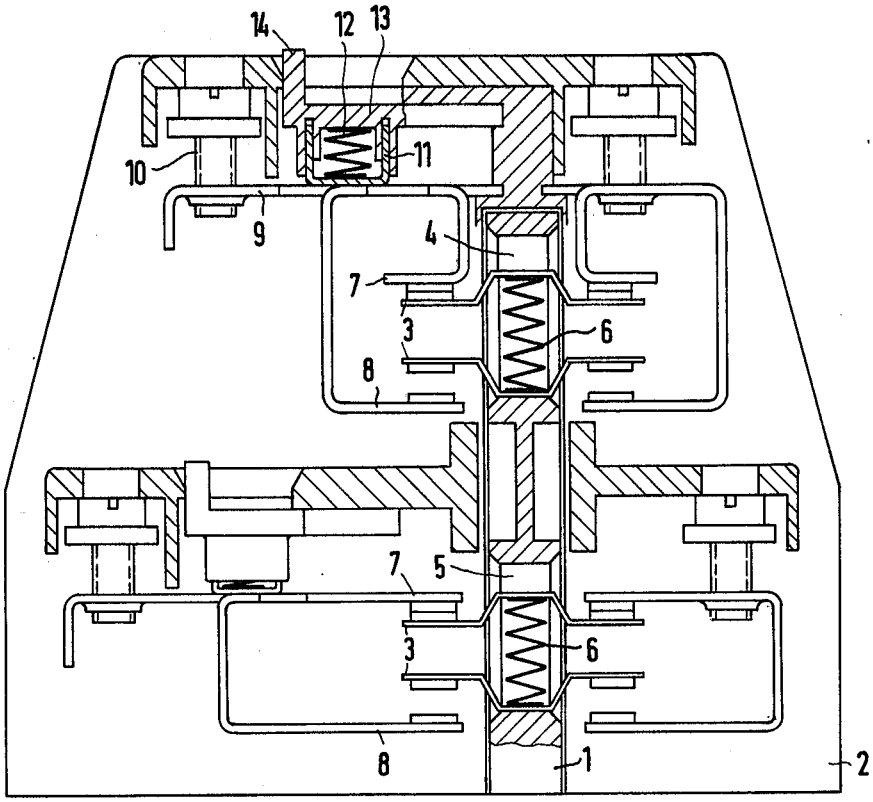
FIG. 1 is a partial, cross-sectional side view of one embodiment of an improved electromagnetic switching apparatus constructed according to the present invention in which the connecting means comprises a plurality of slidable, electrically-conductive intermediate part members.
Figure 2:
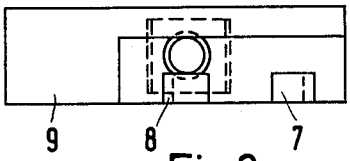
FIG. 2 is a top plan view of the electromagnetic switching apparatus illustrated in FIG. 1.
Figure 3:
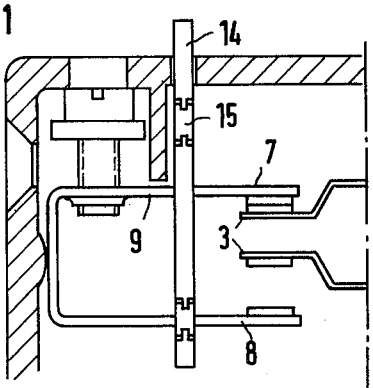
FIG. 3 is a partial, cross-sectional side view of another embodiment of an improved electromagnetic switching apparatus constructed according to the present invention in which the connecting means also comprises a plurality of slidable, electrically-conductive intermediate part members.
Figure 4:
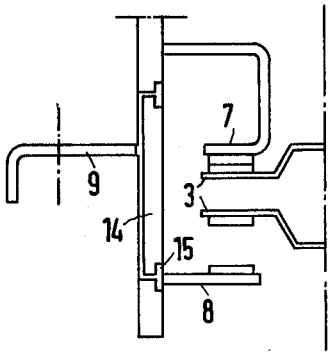
FIG. 4 is a partial, side plan view of another embodiment of the switching apparatus illustrated in FIG. 3.
Figure 5:
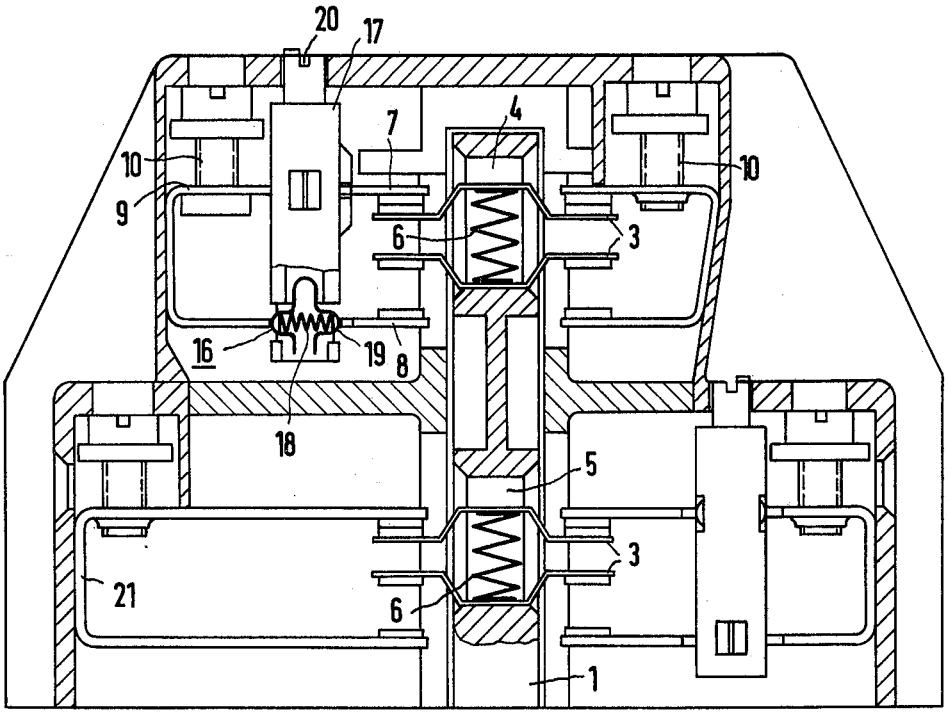
FIG. 5 is a partial, cross-sectional side view of a further embodiment of an improved electromagnetic embodiment of the invention shown in FIGS. 5 and 6. In other words, a reliable contact with terminal element 9 is provided by means of bracket 16.
Figure 6:
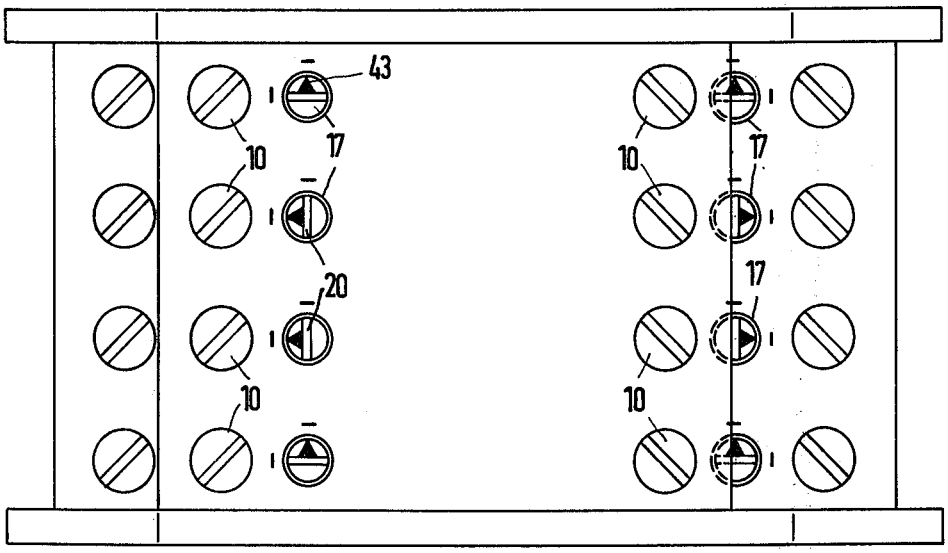
Figure 7:
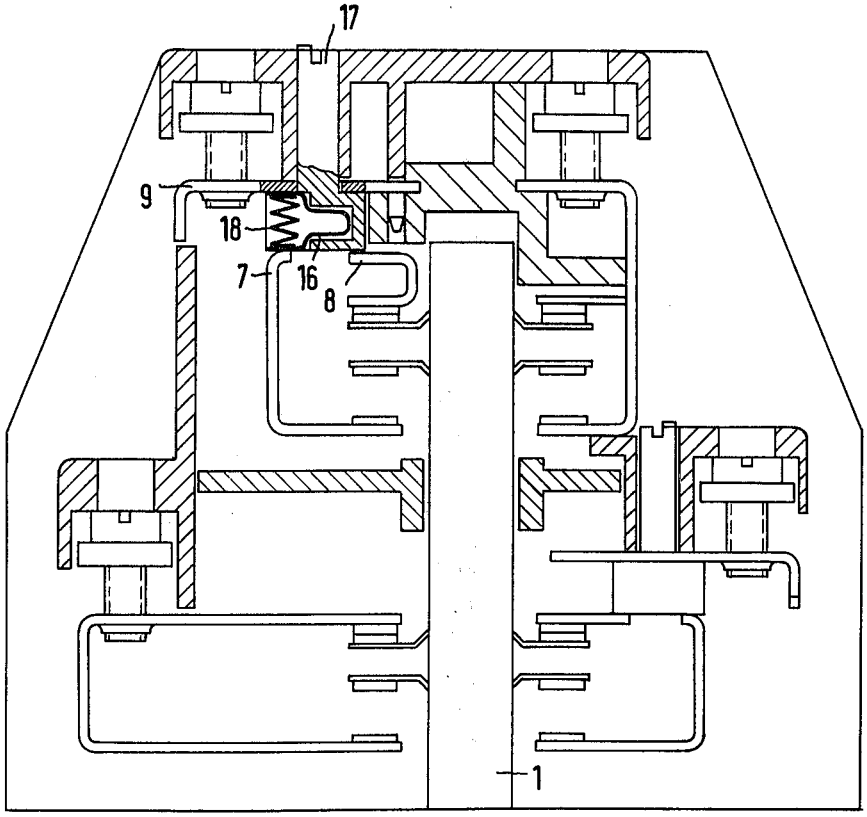
Figure 8:
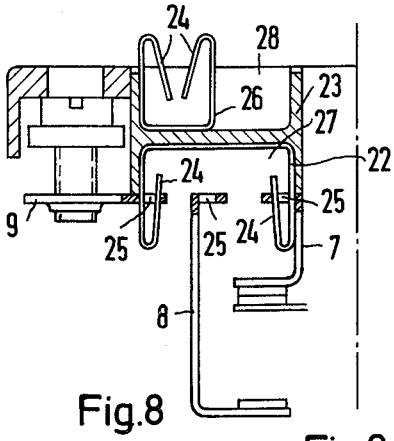
In FIG. 8, a connecting spring 22 having a staple form is secured in a plastic member 23. Legs 24 of spring 22 are bent back in hairpin fashion and are resilient so that the legs can be inserted into openings 25 provided in fixed contact elements 7 and 8 and terminal element 9. Another connecting spring 26 having similar legs 24 is secured to plastic part 23 in a recess 28 disposed on the opposite side of recess 27 in which spring 22 is disposed. As can be seen from the drawings, the distance between legs 24 of connecting spring 26 is less than the distance between the legs 24 of connecting spring 22 and the legs of spring 26 are insertable into openings of fixed contact element 8 and terminal element 9. In order to establish a connection between fixed contact element 8 and terminal element 9, plastic part 23 is turned 180° from its position in which terminal element 9 is electrically coupled to fixed contact element 7.
Figure 9:
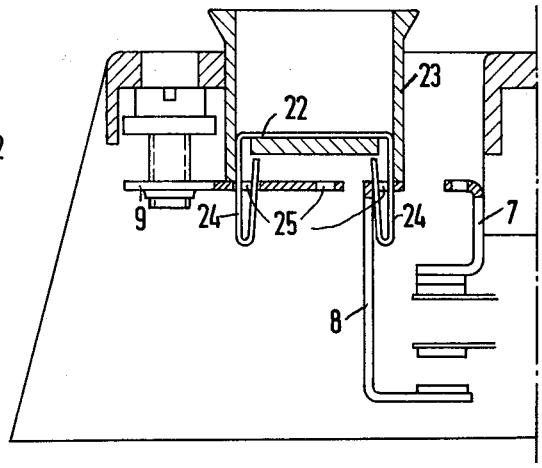
In FIG. 9, plastic part 23 includes only the connecting spring 22. In this embodiment of the invention, terminal element 9 has a pair of openings 25 and fixed contact elements 7 and 8 are connected and disconnected to and from terminal element 9 by laterally moving plastic part 23 from one position to the other in the apparatus housing.
Figure 10:
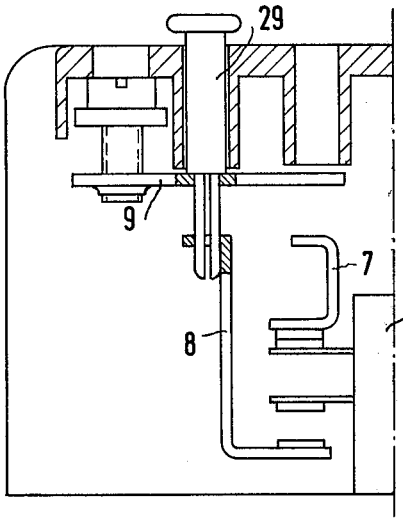
In FIG. 10, electrically-conductive plug members 29 are utilized to electrically connect the fixed contact elements with terminal element 9. This embodiment is designed similar to a crossbar distributor and requires that the contact elements 7 and 8 be located beneath terminal element 9 similar to the embodiment of the invention illustrated in FIG. 7. One advantage of this arrangement is that commercially-available plug members can be utilized.
Figure 13:
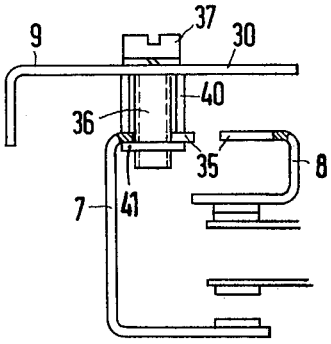
Figure 14:
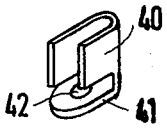

A simple and reliable connecting design is illustrated in the embodiment of the invention shown in FIGS. 13 and 14. In this embodiment, fixed contact elements 7 and 8 are provided with slit-like openings 35 in which a threaded shank 36 of terminal screw 37 can be moved. Terminal element 9 similarly has a correspondingly-shaped opening 38. A clamp 40 is disposed between terminal element 9 and fixed contact elements 7 and 8 and is substantially U-shaped. The ends of fixed contact elements 7 and 8 are surrounded by a lug 41 in which a thread 42 for terminal screw 37 is provided.

In this embodiment of the invention, it is simply necessary to loosen terminal 37 and move the screw laterally until contact element 8 is electrically connected to terminal element 9 in order to change the "make" function of the apparatusinto a "break" function, and vice-versa. Electrical contact is established by means of the U-shaped arms of clamp 40 which are engaged between termial element 9 and the fixed contact element.

In the foregoing specification, the invention has been described with reference to specific exemplary embodiments thereof. It will, however, be evident that various modifications and changes may be made thereunto without departing from the broader spirit and scope of the invention as set forth in the appended claims. The specifications and drawings are, accordingly, to be regarded in an illustrative rather than in a restrictive sense.

What is claimed is:

1. In an electromagnetic switching apparatus including a housing, a plurality of movable contact bridges mounted on a contact bridge carrier, first fixed contact elements which extend around one end of said contact bridges and are coupled to terminal elements for said first fixed contact elements, and electrically-separated second fixed contact elements disposed at the other end of said contact bridges on both sides of said contact bridges, the improvement comprising means for selectively electrically connecting said second fixed contact elements to a common terminal element.

2. The improvement recited in claim 1, wherein said connecting means comprises a plurality of slidable, electrically-conductive intermediate part members.

3. The improvement recited in claim 1, wherein said connecting means comprises a plurality of rotatable spring-loaded electrically-conductive brackets.

4. The improvement recited in claim 3, wherein said spring-loaded brackets are disposed in a plurality of cylinders each rotatably mounted in said housing with the longitudinal axis thereof disposed transversely with respect to the longitudinal axes of said contact bridges.

5. The improvement recited in claim 3, wherein said brackets include detent means.

6. The improvement recited in claim 1, wherein said connecting means comprises a plurality of electrically-conductive plug members.

7. The improvement recited in claim 1, wherein said connecting means comprise a plurality of electrically-conductive clamp connectors.

8. The improvement recited in claim 1, wherein said connecting means are mounted in a plurality of separate housing parts which are detachably mounted on said housing.

9. The improvement recited in claim 1, further comprising position markings disposed on a front side of said housing for indicating said selective electrical connection of said fixed contact elements to said common terminal element.

* * * * *

United States Patent [19]

Streich et al.

[11] 4,117,429

[45] Sep. 26, 1978

[54] ELECTROMAGNETIC SWITCHING APPARATUS

[75] Inventors: Georg Streich; Johann Bauer, both of Amberg, Germany

[73] Assignee: Siemens Aktiengesellschaft, Berlin and Munich, Germany

[21] Appl. No.: 795,495

[22] Filed: May 10, 1977

[30] Foreign Application Priority Data

May 18, 1976 [DE] Fed. Rep. of Germany ..... 2622100

[51] Int. Cl.[2] ..... H01H 67/02

[52] U.S. Cl. ..... 335/132; 335/197

[58] Field of Search ..... 335/121, 126, 127, 135, 335/197, 132

[56] References Cited

U.S. PATENT DOCUMENTS 3,253,092 5/1966 Landow ..... 335/132 X 3,781,727 12/1973 Pollmann et al. ..... 335/132

FOREIGN PATENT DOCUMENTS 1,258,957 1/1968 Fed. Rep. of Germany ..... 335/132

*Primary Examiner*—George Harris

*Attorney, Agent, or Firm*—Kenyon & Kenyon, Reilly, Carr & Chapin

[57] ABSTRACT

An electromagnetic switching apparatus including a housing, movable contact elements mounted on a plurality of contact bridges in the housing, electrically-connected fixed contact elements disposed on both sides of the contact bridges adapted for contact and electrical connection with the movable contacts and the contact bridges, and electrical insulation means for interrupting the electrical connection between the fixed contact elements and the contact bridges in two terminal positions of the contact bridge carrier. The improvement comprises at least one end of the contact bridges extending outwardly beyond the area of contact between the movable contacts and the fixed contacts. The electrical insulation means are movably supported in the switching apparatus housing so as to be operatively engageable in at least one position with the extended ends of the contact bridges for interrupting the electrical connection between at least one of the contact bridges and the fixed contact elements.

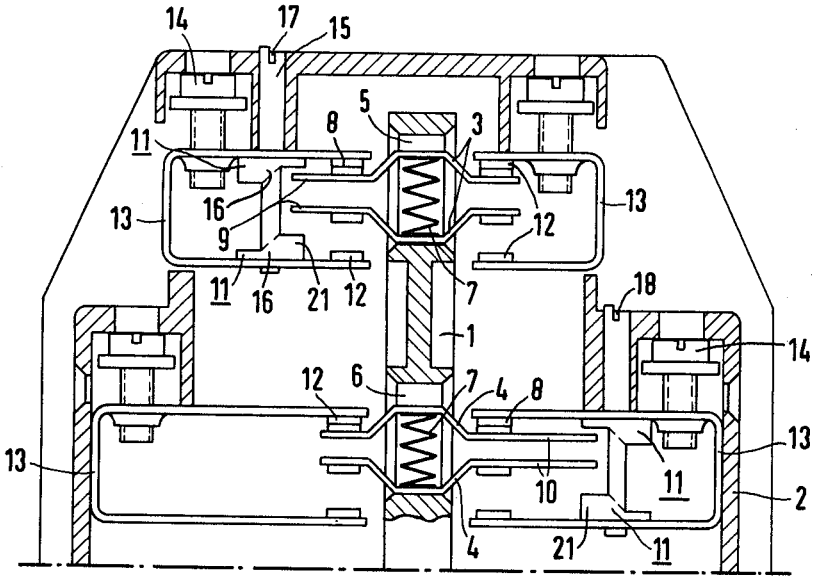

8 Claims, 4 Drawing Figures